US008062720B1

(12) United States Patent
Porat et al.

(10) Patent No.: US 8,062,720 B1
(45) Date of Patent: Nov. 22, 2011

(54) PRINTING MEMBERS FOR DIRECT IMAGING AND METHODS OF PRODUCING SAME

(75) Inventors: Aida Porat, Kibbutz Hanita (IL); Michael Karp, Petah Tikva (IL); Zeev Savion, Eilon (IL); Sergei Bonder, Haifa (IL); Gal Tamir, D.N. Akko (IL)

(73) Assignee: VIM Technologies Ltd, Kibbutz Hanita (IL)

( * ) Notice: Subject to any disclaimer, the term of this patent is extended or adjusted under 35 U.S.C. 154(b) by 0 days.

(21) Appl. No.: 12/127,138

(22) Filed: May 27, 2008

(51) Int. Cl.
*B41M 5/00* (2006.01)

(52) U.S. Cl. ..... 428/32.26; 428/32.28; 428/32.34; 428/32.35; 428/32.36; 101/453; 101/455; 101/457; 101/460; 101/462

(58) Field of Classification Search ..... 428/32.26, 428/32.28, 32.34, 32.35, 32.36; 101/453, 101/455, 457, 460, 462, 466
See application file for complete search history.

(56) References Cited

U.S. PATENT DOCUMENTS

| | | | | |
|---|---|---|---|---|
| 3,234,873 | A | 2/1966 | Miller et al. | |
| 4,833,486 | A | 5/1989 | Zerillo | |
| 5,454,318 | A | 10/1995 | Hirt et al. | |
| 5,525,455 | A | 6/1996 | Kurokawa et al. | |
| 5,738,013 | A | 4/1998 | Kellet | |
| 5,820,932 | A | 10/1998 | Hallman et al. | |
| 6,184,267 | B1 | 2/2001 | Kato et al. | |
| 6,251,523 | B1 | 6/2001 | Takahashi et al. | |
| 6,416,175 | B2 | 7/2002 | Furukawa et al. | |
| 6,479,203 | B1 | 11/2002 | Tashiro et al. | |
| 6,500,524 | B2 | 12/2002 | Moriya | |
| 6,506,479 | B1 * | 1/2003 | Horiuchi | 428/195.1 |
| 6,523,473 | B2 | 2/2003 | Loccufier et al. | |
| 6,620,469 | B2 * | 9/2003 | Totani et al. | 428/32.34 |
| 6,635,320 | B2 | 10/2003 | Wakata et al. | |
| 6,671,070 | B1 | 12/2003 | Schildermans et al. | |
| 6,758,140 | B1 | 7/2004 | Szumla et al. | |
| 6,783,228 | B2 | 8/2004 | Szumla | |
| 7,044,053 | B2 | 5/2006 | Figov et al. | |
| 7,223,453 | B2 | 5/2007 | Takashima et al. | |
| 7,342,685 | B2 | 3/2008 | Minnebo et al. | |
| 7,399,507 | B2 | 7/2008 | Bhatt et al. | |
| 2002/0014175 | A1 * | 2/2002 | Loccufier et al. | 101/450.1 |
| 2002/0034613 | A1 * | 3/2002 | Liu et al. | 428/195 |
| 2003/0072925 | A1 * | 4/2003 | Kiyama et al. | 428/195 |
| 2004/0038152 | A1 | 2/2004 | Goodin et al. | |
| 2004/0051768 | A1 | 3/2004 | DeBoer et al. | |
| 2005/0235854 | A1 | 10/2005 | Vermeersch et al. | |

(Continued)

FOREIGN PATENT DOCUMENTS

| | | |
|---|---|---|
| JP | 56105960 | 8/1981 |

(Continued)

OTHER PUBLICATIONS

Nissan Chemical American Corporation. SNOWTEX.*

*Primary Examiner* — Betelhem Shewareged
(74) *Attorney, Agent, or Firm* — Smith Risley Tempel Santos LLC; Gregory Scott Smith

(57) ABSTRACT

Embodiments of the invention are directed to a printing member for imaging with an inkjet printer using pigment-based aqueous inkjet ink. The printing member may include a substrate and a hydrophilic coating layer. The coasting layer may include acidic colloidal silica whose particles have an elongated shape, a hydrophilic polymer and a crosslinking agent.

11 Claims, 3 Drawing Sheets

U.S. PATENT DOCUMENTS

2006/0107859 A1 5/2006 Sampei
2006/0216443 A1* 9/2006 Kinoshita et al. ..... 428/32.24
2006/0223005 A1 10/2006 Hotta
2006/0223006 A1 10/2006 Shimada et al.
2006/0281027 A1 12/2006 Makino et al.
2008/0233315 A1 9/2008 Aoshima et al.
2008/0268160 A1* 10/2008 Andriessen ..... 427/385.5
2009/0064884 A1 3/2009 Hook et al.

FOREIGN PATENT DOCUMENTS

WO WO 02/078869 10/2002
WO WO 2009/063024 5/2009

* cited by examiner

PRINTING MEMBERS FOR DIRECT IMAGING AND METHODS OF PRODUCING SAME

BACKGROUND

Lithographic printing is based on the principle that oil and water do not mix. A lithographic printing plate has non-image areas which absorb water (hydrophilic areas) and image areas which repel water (hydrophobic areas). For a wet offset lithographic printing, ink is applied to the printing plate to form the image. The plate is dampened so that the ink, which is inherently oily, is rejected by the wet areas and adheres to the image areas. The ink from the inked printing plate is then transferred or "offset" to a rubber blanket. Next, the image on the blanket is transferred to the substrate to produce the printed product.

The standard process of imaging a lithographic printing plate for wet offset printing usually involves use of unhealthy chemicals and using expensive imaging devices, such as computer-to-plate (CTP) devices. In some cases, analog printing devices may be used for imaging. Analog printing employs the use of films and requires chemical processing.

Another process of imaging the lithographic plate is direct imaging, for example using inkjet printers. Currently, the process of imaging an aluminum based lithographic printing plate with inkjet printers requires inkjet printers and inks that are specifically designed for this use. The inks are usually solvent-based or wax-based. Such inks are considerably more expensive and are harmful to the environment.

Therefore, there is a need for a printing member that can be imaged on demand at the print shop in a simple chemistry-free process using non-expensive imaging engines, for example inkjet printers, with water based inks that are environmentally friendly.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features and advantages thereof, may best be understood by reference to the following detailed description when read with the accompanied drawings in which:

Figure 1:
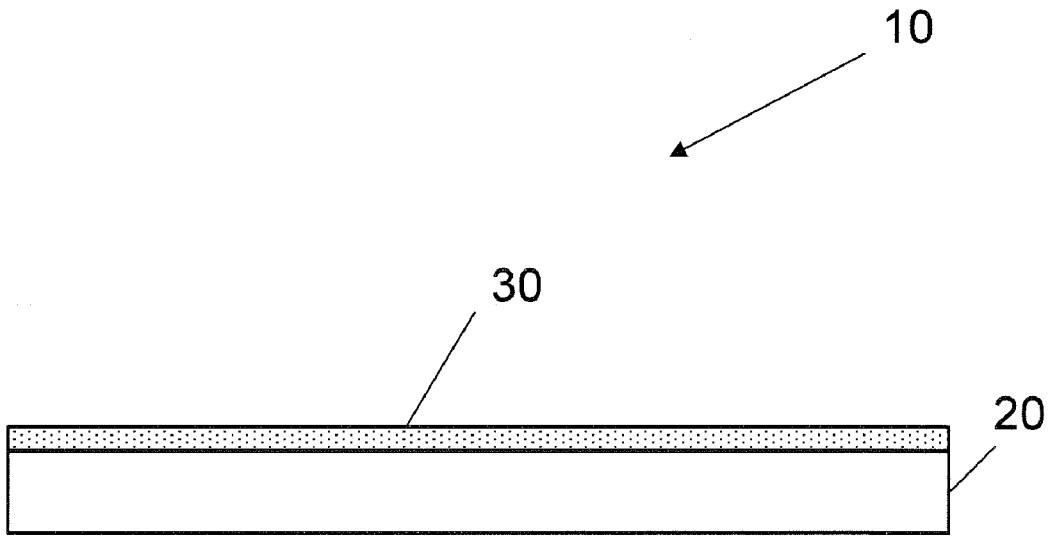
FIG. 1 is an illustration of a printing plate according to some embodiments of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF EMBODIMENTS OF THE INVENTION

In the following detailed description, numerous specific details are set forth in order to provide a thorough understanding of the invention. However it will be understood by those of ordinary skill in the art that the embodiments of present invention may be practiced without these specific details. In other instances, well-known methods, procedures and components have not been described in detail so as not to obscure the present invention.

Embodiments of the present invention are directed to a printing member and a method of producing a printing member for direct imaging using inkjet printing. The imaging of the printing member may be performed by selectively depositing inkjet ink, such as water-based pigmented ink from a standard inkjet printer.

According to some embodiments of the present invention, the imaged printing member may be a lithographic printing plate suitable for conventional wet printing systems. According to other embodiments, the printing member may be applied directly onto a lithograph printing system. It should be noted that the terms "printing member" and "printing plate" are used interchangeably throughout the specification and claims and refer to any type of printing member or surface capable of recording an image defined by regions exhibiting differential affinities for ink. The term "hydrophilic" is used throughout the specification and claims to describe the affinity of a surface for a fluid to prevent ink from adhering thereto. Such fluids may include water and other aqueous and non-aqueous dampening liquids. The term "oleophilic" is used throughout the specification and claims to describe the affinity of a surface for ink to adhere thereto.

According to embodiments of the invention, the printing member may have a base substrate and a coating that includes colloidal silica covering the base substrate. Specifically, the colloidal silica may include particles having an elongated shape or a string-of-pearls shape.

Reference is made to FIG. 1, which is an illustration of a side view of a printing plate according to some embodiments of the present invention. A printing plate 10 may include a substrate 20 and a hydrophilic coating layer 30. According to embodiments of the invention, substrate 20 may be aluminum, for example grained aluminum. Alternatively, substrate 20 may include a self supporting polymer such as polyester (PET). Optionally, a primer layer (not shown) may be added between substrate 20 and coating 30. The primer layer may include polyurethane, acrylic resin, polyvinyl acetate, polyvinyl butyral, polyvinyl alcohol, polyacrylic acid, terpolymers of polyvinyl alcohol, polyvinyl acetate and polyvinyl butyral and any combination thereof. The primer layer may also include a matting agent, such as amorphous silica, alumina or kaolin.

Coating layer 30 may be applied onto substrate 20 by any suitable method as known in the art, for example, wire wound rod coating, roll coating, gravure coating or die coating. Hydrophilic coating layer 30 may include a mixture of acidic colloidal silica and a hydrophilic polymer such as polyvinyl alcohol. The amount of elongated colloidal silica in the coating mixture may vary from about 10 percent by weight to about 45 percent by weight. The amount of hydrophilic polymer in the coating mixture may vary from about 15 percent by weight to about 30 percent by weight.

Coating 30 may further include a cross-linking agent such as glyoxal, gluteraldehyde, and/or melamine-formaldehyde resin. According to an embodiment of the invention, the amount of cross-linking agent needed in the coating layer may vary from about 0.1 percent by weight to about 20 percent by weight.

The coating layer may also include a matting agent to increase the roughness of the coating and therefore aid in the absorption of water used in wet lithographic systems. In some embodiments, the particle size of the matting agent may be between around 1 to around 20 microns. Matting agents such as amorphous silica, alumina and kaolin may be used. Other materials may be added to the coating layer, such as wetting agents, antifoam agents, thickeners, dyes, pigments, fumed silica and hydrophilic resins.

According to embodiments of the invention, the colloidal silica used in the coating layer may have particles with elongated shape unlike typical, spherical silica particles. The length of the elongated particles may vary be between 30 nm and 1000 nm. Particularly, the shape of the elongated particles may be such that the ratio between a short (diameter) and long (length) dimension of a particle may vary between around 3 and 20. For, example, according to embodiments of the invention the elongated particles may have a diameter of 9-15 nm with a length of 40-100 nm. The pH of the elongated colloidal silica may be between 2 and 4.

According to embodiments of the invention, the elongated colloidal silica used in the coating layer may have particles with string-of-pearls shape unlike typical, spherical silica particles. The length of the string-of-pearls particles may vary be between 50 nm and 1000 nm. Particularly, the shape of the string-of-pearls particles may be such that the ratio between a short (diameter) and long (length) dimension of a particle may vary between around 3 and 20. For, example, according to embodiments of the invention the string-of-pearl particles may have particles have a diameter of 18-25 nm with a length of 80-100 nm. The pH of the elongated colloidal silica may be between 2 and 4.

The term "elongated" as used herein throughout the specification and the claims includes both elliptical elongated particles and string-of-pearl elongated particles. The amount of elongated colloidal silica in the coating mixture may vary from about 10 percent by weight to about 50 percent by weight. According to other embodiments of the invention, the amount of elongated colloidal silica in the coating mixture may vary from about 20 percent by weight to about 35 percent by weight.

The hydrophilic polymer may be a polyvinyl alcohol or one its derivatives. A non-exhaustive list of suitable hydrophilic polymers may include poly(vinyl alcohol), poly(vinyl pyrrolidone), poly(acrylic acid), polyacrylamid, polyethylenglycol, arabic gum and polyethylenimine. According to other embodiments of the invention, other hydrophilic polymers may be used. The amount of hydrophilic polymer in the coating mixture may vary from about 15 percent by weight to about 30 percent by weight.

A hydrophilic promoting agent, such as a cationic substance may be added to the coating mixture, for example in order to increase the acidic nature of the colloidal silica. The hydrophilic promoting agent may come in different forms. In one embodiment of the present invention, the hydrophilic promoting agent may be cationic stabilized silica. The silica may be in colloidal or dispersed form. In another embodiment of the invention, the cationic substance may be a salt solution such as for example, sodium chloride or lithium chloride. According to an embodiment of the invention, the amount of cationic substance needed in the coating layer may vary from about 0.2 percent by weight to about 15 percent by weight. Addition of cationic substance above the desired amount may cause gelation of the colloidal silica mixture.

Figure 2:
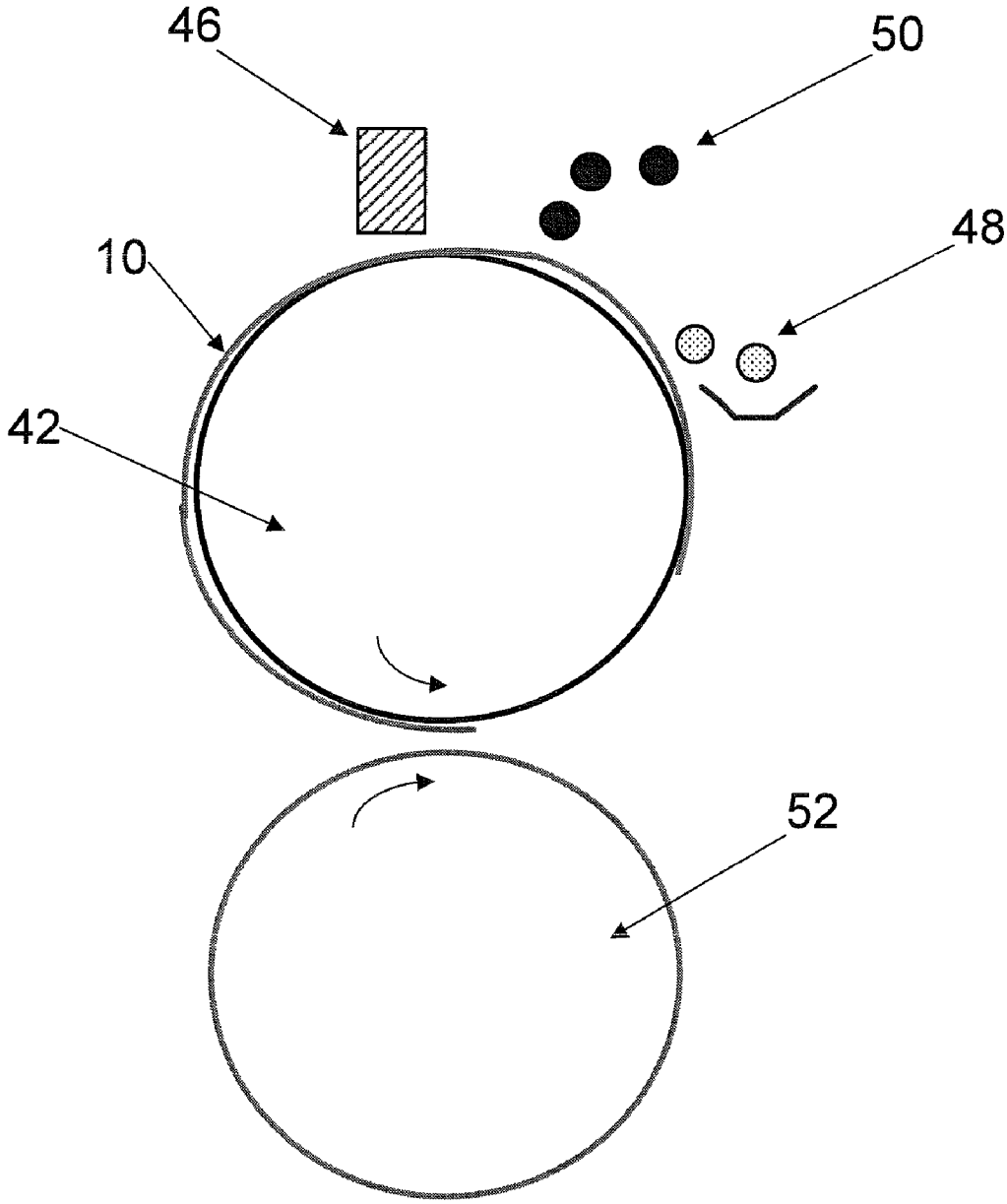
FIG. 2 is an illustration of a lithographic printing apparatus according to embodiments of the invention.

Reference is made to FIG. 2, which is an illustration of a method of direct imaging of a lithographic printing plate on a lithographic printing system according to embodiments of the present invention. A printing plate according to embodiments of the invention, for example printing plate 10 that included a hydrophilic coating with acidic elongated colloidal silica may be placed onto rotating cylinder 42. Once plate 10 is secured to rotating cylinder 42, an inkjet printer 46 may record an image on the surface of coating 30 (FIG. 1) of plate 10. For example, water-based pigmented ink may be used to record the image on coating 30. Once the image is recorded, rotating cylinder 42 may be wetted by a dampening system 48 and then may be inked by an inking system 50. Due to the hydrophilic nature of printing plate 10, the lithographic ink from inking system 50 will only be present on the recorded image produced by inkjet printer 46, which is oleophilic in nature. The lithographic ink is then transferred from printing plate 10 to a blanket cylinder 52 and then to the print material (not shown). Once printing the requited numbers of copies, the imaged printing plate material is removed from rotating cylinder 42. A new printing plate 10 may then be applied to rotating cylinder 42 which will then be ready for the next printing job.

Figure 3:
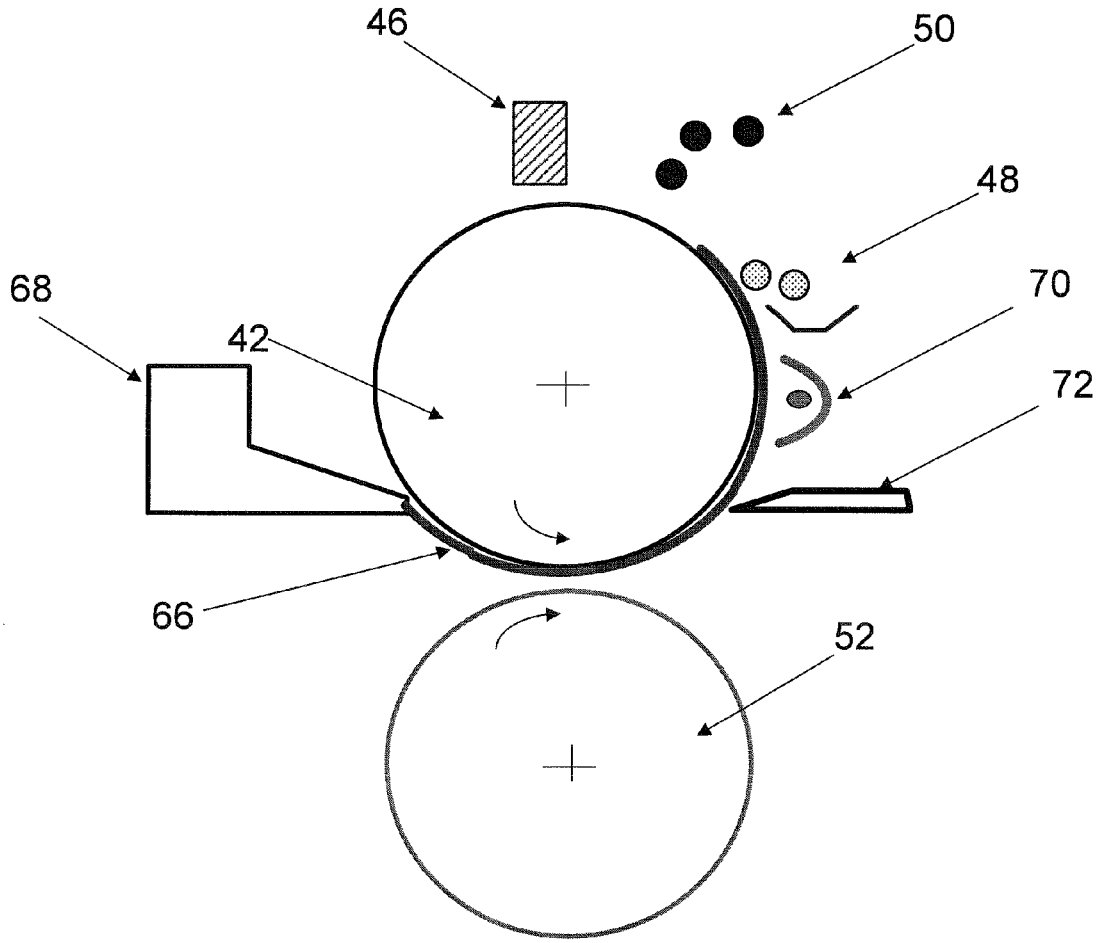
FIG. 3 is an illustration of a plateless lithographic printing apparatus according to embodiments of the invention.

Reference is made to FIG. 3, which is an illustration of a plateless lithographic printing system having a printing member and a method of direct imaging of the plateless printing member according to some embodiments of the present invention. In some embodiments, a hydrophilic mixture that includes acidic elongated colloidal silica may be applied directly to rotating cylinder 42 forming a coating layer 66. The hydrophilic coating 66 may be applied to rotating cylinder 42 by an applicator 68. For example, a blade coating, a gravure coating or a rod coating may be used. It should, however, be understood to a person skilled in the art that embodiments of the invention are not limited in this respect and hydrophilic coating 66 may be applied by any other coating methods.

Then the hydrophilic coating 66 may be treated by a hardening unit 70. For example, hardening unit 70 may be an infrared heater or a blower. It should, however, be understood to a person skilled in the art that embodiments of the invention are not limited in this respect and hydrophilic coating 66 may be hardened by any other method know in the art.

An image is then formed and recorded directly onto hydrophilic coating 66 by inkjet printer 46. For example, water-based pigmented ink may be used to record the image on hydrophilic coating 66. After printing, the imaged hydrophilic coating may be removed by a cleaning unit 72. Cleaning unit 72 may be for example a rotating brash. It should, however, be understood to a person skilled in the art that embodiments of the invention are not limited in this respect and hydrophilic coating 66 may be removed by any other method know in the art.

Alternatively, cleaning unit 72 may be a washing system capable of removing the inkjet image from hydrophilic coating 66. The washing system may involve applying a solvent to hydrophilic coating 66. The solvent may comprise isopropanol, ethanol, methylethylketone, N-methyl-pyrrolidone, ethylacetate dimethylsulfoxide other polar solvents, or mixtures containing these solvents.

EXAMPLES

Following are exemplary processes for the preparation of a printing member according to the present invention, which include preparing a printing member with an aluminum substrate or with a self supporting polymer substrate. In the following examples, component designations are in weight percentages.

Example 1

TABLE 1

| Weight % | Ingredients of hydrophilic coating |
|---|---|
| 24.7 | Isopropyl Alcohol (IPA) (solvent) |
| 0.3 | Wetting agent, sold under the trade name of BYK-333 by BYK, Germany. (wetting agent) |
| 27.6 | 10% water solution of polyvinyl alcohol sold under the trade name of Cevol 125 by Celanese, Dallas, USA. (hydrophilic polymer) |
| 36.3 | Colloidal silica, sold under the trade name of Snowtex OUP by Nissan Chemical America Corporation, USA. (elongated colloidal silica) |
| 0.3 | Cross-linking agent, sold under the trade name of Bacote 20 by MEL Chemicals, England. (cross-linking agent) |
| b. t. w | Water |

The components of Table 1 presented above were mixed and applied to a substrate using a Roll Formed Chrome Plated FT#35 of Buschman Corporation, Ohio, USA. The substrate was a PET film (SH91 clear 175 micron PET film, sold by SKC, Covington, USA) that was treated with a primer produced by Hanita Coating of Israel. The coated film was then dried at 130° C. for 2 minutes.

The hydrophilic coating was imaged by selectively applying an inkjet ink sold under the tradename T5652 UltraChrome K3 cyan inkjet ink by Epson using Epson Stylus 4800 inkjet printer. The imaged plate was then dried at 130° C. during 2 minutes. The plate was then ready for printing on the offset press. Stable optical density and a clear background were obtained by printing on a Heidelberg GTO press.

Example 2

TABLE 2

| Weight % | Ingredients of hydrophilic coating |
|---|---|
| 0.2 | NaCl (cationic salt) |
| 24.6 | Isopropyl Alcohol (IPA) (solvent) |
| 0.15 | Wetting agent, sold under the trade name of Hydropalat 120 by Cognis, Germany. (wetting agent) |
| 27.5 | 10% water solution of polyvinyl alcohol sold under the trade name of Cevol 840 by Celanese, Dallas, USA. (hydrophilic polymer) |
| 36.2 | Colloidal silica, sold under the trade name of Snowtex OUP by Nissan Chemical America Corporation, USA. (elongated colloidal silica) |
| 0.36 | Amorphous silicon dioxide agent, sold under the trade name of Syloid C803 by Grace Davison, Worms, Germany. (matting agent) |
| 0.25 | Cross-linking agent, sold under the trade name of Bacote 20 by MEL Chemicals, England. (cross-linking agent) |
| b. t. w | Water |

The components of Table 2 presented above were mixed and applied to an aluminum sheet using a Roll Formed Chrome Plated FT#35 of Buschman Corporation, Ohio, USA. The aluminum sheet (150 micron sold by Hydro, Oslo, Norway) was treated with a primer produced by Hanita Coating of Israel. The coated film was then dried at 130° C. for 2 minutes.

The hydrophilic coating was imaged by selectively applying an inkjet ink sold under the trade name T5652 UltraChrome K3 cyan inkjet ink by Epson using Epson Stylus 3800 inkjet printer. The imaged plate was then dried at 130° C. during 2 minutes. The plate was then ready for printing on the offset press. Stable optical density and a clear background were obtained by printing on a Heidelberg GTO press.

Example 3

TABLE 3

| Weight % | Ingredients of hydrophilic coating |
|---|---|
| 13.8 | Isopropyl Alcohol (IPA) (solvent) |
| 0.3 | Wetting agent, sold under the trade name of Hydropalat 120 by Cognis, Germany. (wetting agent) |
| 27.5 | 10% water solution of polyvinyl alcohol sold under the trade name of Cevol 840 by Celanese, Dallas, USA. (hydrophilic polymer) |
| 18.1 | Colloidal silica, sold under the trade name of Snowtex OUP by Nissan Chemical America Corporation, USA. (elongated colloidal silica) |
| 9.6 | Colloidal silica, sold under the trade name LudoxCL by Grace Davison, Worms, Germany. (hydrophilic promoting agent) |
| 0.3 | Cross-linking agent, sold under the trade name of Bacote 20 by MEL Chemicals, England. (cross-linking agent) |
| b. t. w | Water |

The components of Table 3 presented above were mixed and applied to a substrate, using a Roll Formed Chrome Plated FT#35 of Buschman Corporation, Ohio, USA. The substrate was a PET film (SH91 clear 175 micron PET film, sold by SKC, Covington, USA) that was treated with a primer produced by Hanita Coating of Israel. The coated film is then dried at 130° C. for 2 minutes.

The hydrophilic coating is imaged by selectively applying an inkjet ink sold under the trade name T5652 UltraChrome K3 cyan inkjet ink by Epson using Epson Stylus 4800 inkjet printer. The imaged plate was then baked at 130° C. during 2 minutes. The plate was then ready for printing on the offset press. Stable optical density and a clear background were obtained by printing on a Heidelberg GTO press.

Example 4

TABLE 4

| Weight % | Ingredients of hydrophilic coating |
|---|---|
| 27.2 | Isopropyl Alcohol (IPA) (solvent) |
| 17.9 | 10% water solution of polyvinyl alcohol sold under the trade name of Cevol 125 by Celanese, Dallas, USA. (hydrophilic polymer) |
| 20.7 | Colloidal silica, sold under the trade name of Snowtex PS-MO by Nissan Chemical America Corporation, USA. (colloidal silica - string of pearl) |
| 7.1 | Cationic stabilized silica, sold under the trade name of AerodispWK 341 of Degussa. (hydrophilic promoting agent) |
| 0.4 | Cross-linking agent, sold under the trade name of Bacote 20 by MEL Chemicals, England. (cross-linking agent) |
| b. t. w | Water |

The components of Table 4 presented above were mixed and applied to a substrate, using a Roll Formed Chrome Plated FT#35 of Buschman Corporation, Ohio, USA. The substrate was a PET film) SH91 clear 175 micron PET film, sold by SKC, Covington, USA) that was treated with a primer produced by Hanita Coating of The coated film was then dried at 130° C. for 2 minutes.

The hydrophilic coating was imaged by selectively applying an inkjet ink T5652 UltraChrome K3 cyan inkjet ink of Epson using Epson Stylus 4800 inkjet printer. The imaged plate was then baked at 130° C. during 2 minutes. The plate was then ready for printing on the offset press. Stable optical density and a clear background were obtained by printing on a Heidelberg GTO press.

Example 5

TABLE 5

| Weight % | Ingredients of hydrophilic coating |
|---|---|
| 27.7 | Isopropyl Alcohol (IPA) (solvent) |
| 18.3 | 10% water solution of polyvinyl alcohol sold under the trade name of Cevol 165 by Celanese, Dallas, USA. (hydrophilic polymer) |
| 27.7 | Colloidal silica, sold under the trade name of Snowtex OUP by Nissan Chemical America Corporation, USA. (elongated colloidal silica) |
| 7.2 | Cationic stabilized silica, sold under the trade name of AerodispWK 341 of Degussa. (hydrophilic promoting agent) |
| 0.3 | Cross-linking agent, sold under the trade name of Cymel 385 by Cytec Industries, USA. (cross-linking agent) |
| 1.2 | Orthophosphoric acid 10% solution. (catalyst for cross-linking agent) |
| b. t. w | Water |

The components of Table 5 presented above were mixed and applied to a substrate, using a Roll Formed Chrome Plated FT#35 of Buschman Corporation, Ohio, USA. The substrate was grained aluminum sheet (125 micron, sold by Lawrence & Frederick, USA, under the trade name of 900SX). The coated film was then dried at 130° C. for 2 minutes.

The hydrophilic coating was imaged by selectively applying an inkjet ink T5652 UltraChrome K3 cyan inkjet ink of Epson using Epson Stylus 3800 inkjet printer. The imaged plate was then baked at 130° C. during 2 minutes. The plate was then ready for printing on the offset press. Stable optical density and a clear background were obtained by printing on a Heidelberg GTO press.

Example 6

TABLE 6

| Preparing the primer layer coated under hydrophilic layer: | |
|---|---|
| Weight % | Ingredients of hydrophilic coating |
| 92 | Isopropyl Alcohol (IPA) (solvent) |
| 8 | Terpolymer consisting of polyvinyl alcohol, polyvinyl acetate and polyvinyl butyral, sold under the trade name of Mowital B20H by Kuraray, Japan. |

The components of Table 6 presented above were mixed and applied to the aluminum sheet 150 micron of Hydro, Oslo, Norway, using a Roll Formed Chrome Plated FT#10 of Buschman Corporation, Ohio, USA. The coated film was then dried at 100° C. for 1 minute. The components of Table 5 presented above were mixed and applied to the coated film The hydrophilic coating was imaged by selectively applying an inkjet ink T5652 UltraChrome K3 cyan inkjet ink of Epson using Epson Stylus 3800 inkjet printer. The imaged plate was then baked at 130° C. during 2 minutes. After baking the plate was then ready for printing on the offset press. Stable optical density and a clear background were obtained by printing on a Heidelberg GTO press.

Example 7

The formulation below does not contain a hydrophilic promotion agent.

TABLE 7

| Weight % | Ingredients of hydrophilic coating |
|---|---|
| 21.8 | Isopropyl Alcohol (IPA) (solvent) |
| 0.3 | Wetting agents, sold under the trade name of Hydropalat 120 by Cognis, Germany. (wetting agent) |
| 27.6 | 10% water solution of polyvinyl alcohol sold under the trade name of Cevol 840 by Celanese, Dallas, USA. (hydrophilic polymer) |
| 36.3 | Colloidal silica, sold under the trade name of Snowtex OUP by Nissan Chemical America Corporation, USA, pH 2-4. (colloidal silica) |
| 0.25 | Cross-linking agent, sold under the trade name of Bacote 20 by MEL Chemicals, England. (cross-linking agent) |
| b. t. w | Water |

The components of Table 7 presented above were mixed and applied to a substrate, SH91 clear 175 micron PET film, sold by SKC, Covington, USA. The PET film was treated with a primer produced by Hanita Coating using a Roll Formed Chrome Plated FT#35 of Buschman Corporation, Ohio, USA. The coated film was than dried at 130° C. for 2 minutes.

The hydrophilic coating was imaged by selectively applying an inkjet ink T5652 UltraChrome K3 cyan inkjet ink of Epson using Epson Stylus 4800 inkjet printer. The imaged plate was then baked at 130° C. during 2 minutes.

The plate was installed on a Heidelberg GTO printing press. After 200-500 impressions toning appears on background of the printed surface.

Example 8

The formulation below includes colloidal silica having spherical particles.

TABLE 8

| Weight % | Ingredients of hydrophilic coating |
|---|---|
| 13.8 | Isopropyl Alcohol (IPA) (solvent) |
| 0.3 | Wetting agent, sold under the trade name of BYK-333 by BYK, Germany. (wetting agent) |
| 27.6 | 10% water solution of polyvinyl alcohol sold under the trade name of Cevol 840 by Celanese, Dallas, USA. (hydrophilic polymer) |
| 29 | Colloidal silica, sold under the trade name of Snowtex O by Nissan Chemical America Corporation, USA, pH 2-4. (colloidal silica) |
| 0.3 | Cross-linking agent, sold under the trade name of Bacote 20 by MEL Chemicals, England. (cross-linking agent) |
| b. t. w | Water |

The components of Table 8 presented above were mixed and applied to a substrate, SH91 clear 175 micron PET film, sold by SKC, Covington, USA. The PET film was treated with a primer produced by Hanita Coating using a Roll Formed Chrome Plated FT#35 of Buschman Corporation, Ohio, USA. The coated film was than dried at 130° C. for 2 minutes.

The hydrophilic coating was imaged by selectively applying an inkjet ink T5652 UltraChrome K3 cyan inkjet ink of Epson using Epson Stylus 4800 inkjet printer. The imaged plate was then baked at 130° C. during 2 minutes.

The plate was installed on a Heidelberg GTO printing press. During printing on the offset press, the image disappears from the printing plates. Due to the poor adhesion of the inkjet ink pigment to the hydrophilic layer, the pigment was washed from the printing plate by the fountain solution of the printing press.

Example 9

The formulation below is basic and includes colloidal silica having elongated particles with a pH of 9-10.5.

TABLE 9

| Weight % | Ingredients of hydrophilic coating |
|---|---|
| 8.6 | Isopropyl Alcohol (IPA) (solvent) |
| 17.9 | 10% water solution of polyvinyl alcohol sold under the trade name of Cevol 125 by Celanese, Dallas, USA. (hydrophilic polymer) |
| 20.7 | Colloidal silica, sold under the trade name of Snowtex UP by Nissan Chemical America Corporation, USA, pH 9-10.5. (colloidal silica) |
| 7.1 | AerodispWK 341 of Degussa is cationic stabilized silica in dispersed form. (colloidal silica) |
| 0.4 | Cross-linking agent, sold under the trade name of Bacote 20 by MEL Chemicals, England. (cross-linking agent) |
| b. t. w | Water |

The mixture of components present above in Table 9 did not acquire an acceptable hydrophilic coating due to the poor compatibility of the components. Therefore, this was coating was not tested on a printing press.

Listed below is a list of the different components used in the examples. The list includes the manufacturers' specification of each component.

Snowtex OUP of Nissan Chemical America Corporation, USA is exemplary of colloidal silica, which is acidic and comprises particles of elongated shape. It has a pH of 2-4. The short particles size is 10-15 nm and the long particles size is 50-70 nm. Its minimum weight loading is 10% and a maximum weight amount addition is 50% present.

Snowtex PS-MO of Nissan Chemical America Corporation, USA is exemplary of colloidal silica, which is acidic and comprises particles of string-of-pearl shape. It has a pH of 2-4. The short particles size is 10-15 nm, and the long particles size is 120-160 nm. Its minimum weight loading is 10% and a maximum weight amount addition is 50% present.

Snowtex O of Nissan Chemical America Corporation, USA is exemplary of colloidal silica, which is acidic and comprises particles of spherical shape. It has a pH of 2-4.

Snowtex UP of Nissan Chemical America Corporation, USA is exemplary of colloidal silica, which is alkali and comprises particles of elongated shape. It has a pH of 9-10.5. Its short particles size is 10-15 nm and its long particles size is 50-70 nm.

Ludox CL of Grace Davison, Worms, Germany is a cationic stabilized silica in colloid form. It also acts as a hydrophilic promotion agent.

WK 341 of Degussa, is a cationic stabilized silica in dispersed form. It also acts as a hydrophilic promotion agent.

Syloid C803 of Grace Davison, Worms, Germany is a matting silica with a particles size of approximately 3 microns.

Syloid C809 of Grace Davison, Worms, Germany is a matting silica with a particles size of approximately 9 microns.

While certain features of the invention have been illustrated and described herein, many modifications, substitutions, changes, and equivalents will now occur to those of ordinary skill in the art. It is appreciated that various modifications may occur to those skilled in the art that, while not specifically shown herein, are nevertheless within the true spirit and scope of the invention.

What is claimed is:

1. A lithographic printing plate for wet offset printing, the lithographic printing plate comprising:

a base substrate; and a hydrophilic coating layer over the base substrate, the coating layer including acidic colloidal silica having particles of an elongated shape, hydrophilic polymer and a crosslinking agent, wherein image recorded areas on the surface of the hydrophilic coating layer, which are imagewise covered by pigment-based aqueous inkjet ink, are hydrophobic and areas of the coating layer which were not covered by the pigment-based aqueous inkjet ink are hydrophilic.

2. The printing member of claim 1, wherein the colloidal silica comprises over 10% by weight of the coating mixture.

3. The printing member of claim 1, wherein the coating layer comprises a hydrophilic promotion agent.

4. The printing member of claim 1, wherein elongated particles of the colloidal silica are of string-of-pearls shape.

5. The printing member of claim 1, wherein the hydrophilic coating comprises one or more hydrophilic polymers selected from the group consisting of poly(vinyl alcohol), poly(vinyl pyrrolidone), poly(acrylic acid), polyacrylamid, polyethylene glycol, Arabic gum and polyethylenimine.

6. The printing member of claim 3, wherein the hydrophilic promotion agent is salt.

7. The printing member of claim 1, wherein the length of the elongated particles varies between 40 nm and 1000 nm and the diameter of the elongated particles varies between 5 nm and 20 nm.

8. The printing member of claim 3, wherein the hydrophilic promotion agent is a cationic stabilized silica in colloid or dispersed form.

9. The printing member of claim 1, further comprising a matting agent.

10. The printing member of claim 1, further comprising a primer layer over the base substrate.

11. The printing member of claim 10, wherein the primer layer comprises terpolymer consisting of polyvinyl alcohol, polyvinyl acetate and polyvinyl butyral.

* * * * *